United States Patent [19]

Saxby

[11] Patent Number: 4,697,523

[45] Date of Patent: Oct. 6, 1987

[54] COMPRESSED GAS POWERED AMMUNITION FOR GUNS

[75] Inventor: Michael E. Saxby, Stratford-Upon-Avon, England

[73] Assignee: Hilvenna Limited, Warwickshire, England

[21] Appl. No.: 813,062

[22] Filed: Dec. 26, 1985

[30] Foreign Application Priority Data

| | | | |
|---|---|---|---|
| Jan. 11, 1985 | [GB] | United Kingdom | 8500706 |
| Jan. 31, 1985 | [GB] | United Kingdom | 8502492 |
| Mar. 20, 1985 | [GB] | United Kingdom | 8507225 |
| Aug. 10, 1985 | [GB] | United Kingdom | 8520129 |

[51] Int. Cl.[4] ..... F42B 5/02; F41B 11/08

[52] U.S. Cl. ..... 102/440; 42/16; 124/57; 124/70; 124/74

[58] Field of Search ..... 124/57, 70, 74; 42/16; 102/430, 440

[56] References Cited

U.S. PATENT DOCUMENTS

| | | | |
|---|---|---|---|
| 387,256 | 8/1888 | Pratt | 102/430 |
| 4,531,458 | 7/1985 | Saxby | 102/440 |
| 4,601,278 | 7/1986 | Kim | 124/74 |

FOREIGN PATENT DOCUMENTS

| | | | |
|---|---|---|---|
| 16072 | 6/1898 | Sweden | 102/440 |

*Primary Examiner*—Deborah L. Kyle
*Assistant Examiner*—Michael J. Carone
*Attorney, Agent, or Firm*—Neil F. Markva

[57] ABSTRACT

A simple to manufacture high pressure rechargeable ammunition cartridge comprising a hollow pressure casing 20 providing a gas storage space 19 to hold compressed gas therein, with a discharge passage 25 in a front part of said casing said gas storage space; an actuation passage 24 extending into said casing from the rear; a valve opening 52 at a front end of said actuation passage, and a valve member which has a normal position wherein it closes said valve opening and blocks said discharge passage, and is movable bodily forwards as shown from said normal position to open both said valve opening and said discharge passage to allow gas to escape from the pressure casing directly through both of said passages to drive a missile. The valve member may be modified so as to be dischargeable from the cartridge and may form part of a missile.

17 Claims, 20 Drawing Figures

FIG. 5.
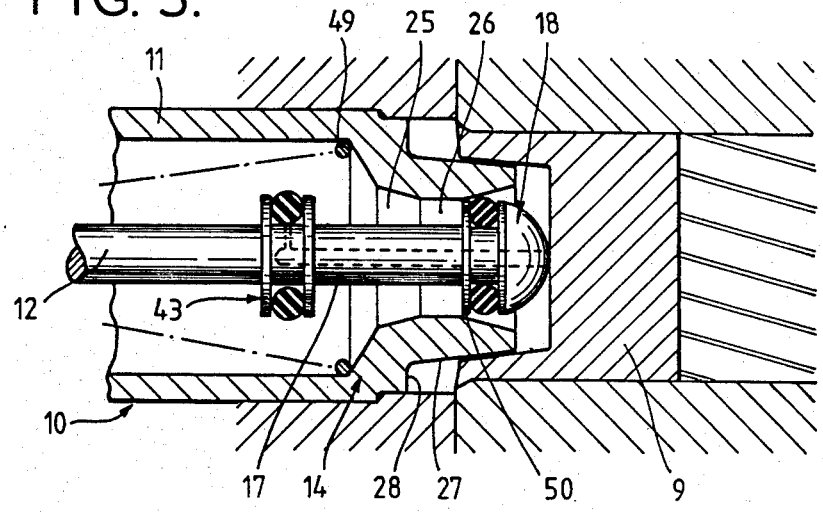
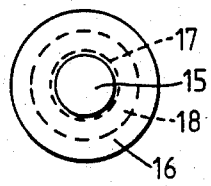
FIG. 6.
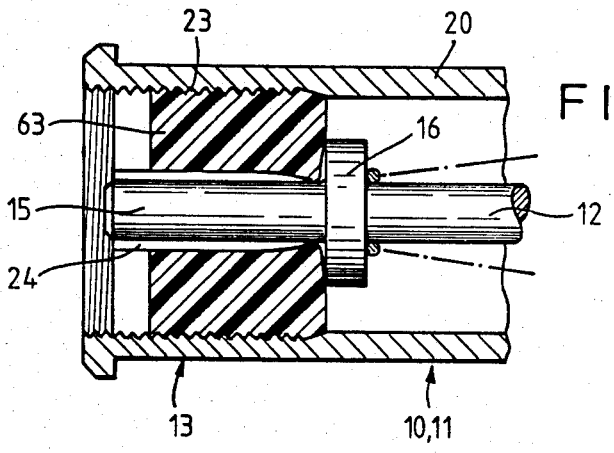
FIG. 7.

COMPRESSED GAS POWERED AMMUNITION FOR GUNS

FIELD OF THE INVENTION

This invention concerns rechargeable cartridge ammunition for guns such as nail guns, and small arms, e.g. pistols, rifles and automatic small arms, which ammunition is adapted to utilize air or another gas at high pressures to propel missiles.

BACKGROUND OF THE INVENTION

In our British Patent Specification No. 1601918 it is mentioned that between the years 1880 and 1900 there were various proposed forms of compressed air powered ammunition for use in a suitable weapon for shooting, without some of the cost and other disadvantages inherent in using firearms; but such proposals were unsuccessful for various reasons, and the idea seems to have been abandoned for a long time. In fact, in Swiss Pat. No. 16072 granted in 1898 to Dr. J. Meuli-Hilty there was proposed a form of cartridge of a king (hereinafter referred to as "said kind") which comprised a hollow pressure casing having an internal gas storage space, a rear passage leading rearwards from the storage space, a front passage extending forwards from the storage space, and a movable member having a normal position in which it prevents gas flowing from said storage space, which movable member is movable forwards to allow gas to flow from said storage space.

However, the front and rear passages were provided in spaced apart stuffing boxes secured in the casing, and the movable member was in the form of a hollow tube co-axial with the casing. The tube extended through the stuffing boxes and was provded with two ports spaced apart so as to be closed by the stuffing boxes when the tube was in the normal position. The tube had one end portion closed by a valve, which end portion was exposed at a rear end of the cartridge, and had a front end portion which terminated within a front part of the casing to the rear of a bullet seated in a front end of the casing. A spring urged the tube rearwards to bring a stop on the front end position of the tube into contact with a front one of the two stuffing boxes. The storage space between the stuffing boxes could be charged with compressed gas by removing a nut from a rear end of the tube, opening the valve, and rotating the tube to bring a rear one of the ports into alignment with a radial opening in the rear stuffing box. Thereafter, the valve was closed, the nut was replaced. The cartridge was discharged by driving the tube forwrds towards the bullet, thereby bringing the front port to a small space between the bullet and the front stuffing box, and thereby allowing gas to escape from the large space to the small space via a restricted path comprising the radial opening, the rear port, the interior of the tube and the front port. At all times the tube occupied the front and rear passages and was engaged by the stuffing boxes to seal these passages.

This proposed form of cartridge does not appear to have been successful, and the proposal does not appear to have given rise to any subsequent developments, possibly because of the disadvantages inherent in the cartridge, in particular:

(a) the discharge path provides a severe restriction upon the rate of gas discharge, whereas a rapid discharge is necessary;

(b) the stuffing boxes used to cover the ports and seal the passages would not have been effective to retain gas at the high pressure required for long periods, and any attempt to provide effective seals would have given rise to considerable frictional resistance to movement of the tube, unless the latter had a very small diameter; and (c) the procedure for charging the cartridge was complicated and required an externally accessible manually operable stop-cock form of value.

In our British Patent Specification No. 2124346A there are disclosed rechargeable cartridges which have some similiarity with that disclosed in Swiss Pat. No. 16072 of 1898, in that the cartridges are generally of said kind. However, the cartridge disclosed in said Specification No. 2124346A are of a servo operated form in which the cartridge comprises discharge valve means to close the front passage (which valve means is openable by a first force for forwards discharge of said gas to propel a missile): a servo-mechanism adapted to utilize energy from the stored gas to provide said first force; and servo actuating means actuable by a second force smaller than said first force.

In these two operated cartridges, the servo mechanism comprises a piston alongside the rear passage, and the movable member forms part of the servo actuating means. The movable member is movable forwards from the normal position to cause gas to be discharged rearwards from the storage space via said rear passage to expose the piston to said opposed unequal thrusts, one of which thrusts is provided by gas stored under pressure in the casing. The piston is movable by said unequal thrusts to move the discharge valve means forcibly rearwards to allow gas to escape from said gas storage space directly forwards through the front passage to propel a missile.

The piston thus utilizes energy from compressed gas stored in the casing to provide power for opening the discharge valve means, for rapid forwards discharge of the compressed gas.

The servo operated cartridge has the advantage that initial actuation of the actuating means is not substantially resisted by the gas pressure in the storage space, but unlike the cartridge shown in said Swiss Pat. No. 10672 and our aforesaid British Pat. No. 1601918, has the major advantages that the initial actuation only requires a small actuating force to be applied to the movable member of the actuating means, and that initial actuation enables the stored gas pressure to be utilizes by the integral servo-mechanism which acts rapidly and automatically to provide the large force required to open the discharge valve means.

However, the servo-operated cartridges have the disadvantages in that they:

(d) are complex, (e) have to be constructed with great precision, (f) are expensive, and (g) incur a slight delay due to the sequential operation of the parts constituting the servo-mechanism culminating in the rearwards (towards the base) movement of the piston, before the discharge valve means is opened.

What is needed is a cartridge which can be constructed so as to be used in known small arms as a substitute for explosive (chemical) cartridges, while avoiding or reducing the problems mentioned hereinbefore and, in particular, the aforementioned disadvantages (a) to (g).

The present invention has some similiarity with the disclosed in Swiss Pat. No. 16072 or 1898 in that is is of said kind.

SUMMARY OF THE INVENTION

According to the present invention there is provided a cartridge generally of the said kind and characterised in that:

(a) the movable member is a movable valve member, (b) the movable valve member is movable bodily forwards from said normal position to allow gas to escape from the storage space directly through both of said passages.

The movable valve member is preferably provided with a closure member and a plug; the rear passage is preferably provided in an insert secured in a base end portion of the casing, and extends forwards to serve as an actuation passage in the casing; and the front passage is preferably a discharge passage which comprises a cylindrical throat. The cartridge is preferably arrangede so that the movable valve member is inherently stable in the normal position in which the closure member closes the actuation passage and the plug blocks the throat to retain gas in the storage space; and so that the movable valve member is movable forwards from said normal position:

(a) to open the actuation passage to allow gas to escape rearwards from the pressure casing, and (b) to drive the plug forwards out of said throat to allow compressed gas to escape forwards from said pressure casing directly through said throat.

To improve gas retention without loss of pressure, the effective passage-closing area of the plug is preferably less than the effective passage-closing area of the closure member so that, in the normal position, the pressure of the stored gas produces a rearwards thrust on the closure member which is slightly or fractionally greater than a forwards thrust exerted on the plug by said pressure, whereby to utilize said pressure to provide a rearwardly directed force or bias to retain the movable valve member in the normal position, to the extent of the difference between said thrusts. The cartridges are preferably arranged to be chargeable to pressures of at least $5\times10^6$Pa and preferably pressures of from $10^7$ to $7\times10^7$Pa (at least 700 pounds per square inch and preferably from 1400 to 10,000 lbs/inch$^2$); and the ratio of said passage closing areas, taken into conjunction with the overall areas and the charging pressure, is preferably such that said rearwardly directed force is at least 100 gms (0.1N) and is preferably 1 to 5N (Kgms), but may be more for certain purposes.

The cartridge of the invention is, in general, a cartridge comprising a hollow pressure casing and a movable valve member which, when the pressure casing is charged with compressed gas, is held in a normal position in which it closes a front discharge passage in the casing and closes a valve opening at a front end of a rear actuation passage poen at the rear of the pressure casing, the valve member being movable from said normal position to open both said front discharge passage and said valve opening to allow gas to pass directly from the interior of the casing directly forwards through the discharge passage and directly rearwards through the actuation passage.

Thus, the problems and disadvantages of tortuous discharge paths, such as those associated with the cartridge proposed in Swiss Pat. No. 16072 of 1898, are avoided.

The cartridge of the invention is extremely simple to manufacture, and may be constructed as a simple assembly of only two structural parts, such as a base insert and a body of the casing, together with the movable valve member, and one or more resilient or compressible components, e.g. for sealing.

In some of the embodiments disclosed herein the movable valve member is held captive in the cartridge casing. These embodiments may have a spring to provide a rearwardly directed force on the movable valve member, and can be constructed so that the thrust of the spring is opposed by a forwardly directed force exerted by the gas pressure upon the valve member, by making the effective passage closing area of the plug slightly larger than the effective area of the closure member, so that the cartridge automatically limits the pressure to which it can be charged. However, our experimental tests have indicated that the service life of such forms may be restricted by wear, damage or failure of the compressible or resilient components, and, although these embodiments of the cartridges are easily dismantled for replacement of such components, such a restricted service life may be of a disadvantage for certain purposes.

An object of a preferred form of the invention is to enable this disadvantage to be avoided.

According to a preferred form of the invention the cartridge is characterized that the movable valve member is dischargeable through the discharge passage so as, in use, to be propelled from the casing.

Thus, after discharge of the cartridge, a new movable valve member, with a new sealing component or components, for sealing the passages, can be inserted into the cartridge through the discharge passage prior to the cartridge being recharged with compressed gas.

The cartridge preferably forms part of a round of ammunition which further comprises a missile.

The movable valve member may be separate from, secured to, or integral with the missile.

The actuation passage may serve to house an elongate actuating member which is a free sliding or lose fit in the passage so as to restrict, but not prevent, the flow of compressed gas therealong. Alternatively, the actuation passage may be arranged to admit an elongate firing pin of a gun, for displacing the closure member from the opening.

The actuating member may be secured to, or part of, the movable valve member, but is preferably separate therefrom.

The movable valve member preferably has a maximum dimension which is less than the caliber diameter of the missile to facilitate discharge of the movable valve member from the gun.

The base insert preferably extends forward within the casing to provide front portions to engage an internal part of the casing adjacent to the discharge passage to align the latter and the actuation passage on a common axis. Said front portions are preferably arranged to serve as guide means for aligning the movable valve member with the actuation passage during insertion of the movable valve member into the casing.

The movable valve member is preferably end for end symmetrical so that the plug and closure member are the same, to facilitate insertio of the movable valve member into the casing. In order to provide said rearwards thrust on the closure member which is fractionally greater than the forwards thrust which is exerted by the stored gas on the plug, the effective diameter of the throat of the discharge passage is preferably fractionally less than the effective diameter of the valve opening at the front of the actuation passage, said effective diameter being disposed where the sealing component or components on the valve member effect sealing engagement with the surfaces defining the opening and the throat.

The present invention also provides apparatus for shooting comprising a gun and the cartridge.

The gun may have an elongate firing pin mounted on a breech block, and is preferably characterized in that the breech block comprises a front portion to close the gun breech, a rear portion on which the firing pin is mounted and bias means thrusting the rear portion rearwards relative to the front portion to urge the breech block to an extended condition in which the firing pin is retracted into the front portion; and in that the gun has breech block control means for moving the breech block and moving the rear portion forwards relative to the front portion to extend the firing pin to project in front of the front portion along said actuation passage.

The invention includes a gun constructed and arranged for use in said apparatus. The gun and the cartridge are particularly safe for use by non-expert persons, because the breech block prevents the gun being used with standard firearms cartridges and because the cartridge can not be discharged by impacts upon its base, and requires a long firing pin, inserted along the actuation passage, to be driven forcibly forwards to drive the movable valve member from its normal position.

The forms of the cartridge provided with an actuating member in the actuation passage, may be used in standard firearms. However, these cartridges preferably form part of shooting apparatus of the invention and are preferably provided with safety means to cooperate with or interengage safety means provided in a gun of the apparatus to prevent the latter operating (firing) standard explosive chemical propellant containing cartridges. The safety means preferably comprises a projection on either the cartridge or the breech block of the firearm and a recess in the front of the breech block or the base of the cartridge to receive the projection so as to allow the firing pin to strike the actuating member, whilst preventing the firing pin striking a detonator of a standard firearms cartridge should such a cartridge be inserted into the firing chamber of the gun.

In connection with the various forms of re-chargeable re-useable compressed gas, e.g. air, powered cartridges which we have developed for small arms such as air guns and, more recently for use as a direct substitute for explosive cartridges in firearms, and we have experienced a large variety of problems in providing adequate location and support for the missiles or bullets, especially bullets of lead and other ductile materials.

We have proposed and tried various solutions to some of these problems, but all have incurred disadvantages such as increased manufacturing costs, limitations on choice of missile material and/or vulnerability of the fronts of the cartridges to damage, as compared with the traditional crimping of brass cartridges to hold the missiles.

An object of a further aspect of the invention is to enable said problems and disadvantages to be reduced or avoided.

According to the present invention there is further provided a cartridge comprising a hollow casing having a hollow front portion through which a gas or gaseous material can be discharged, for propulsion of a missile, and characterized in that said front portion extends forwards from a shoulder provided by the body; in that a sleeve is supported on said front portion so as to abut said shoulder; and in that a missile receiving portion of said sleeve projects forwards beyond said front portion, to receive and grip a missile.

The invention includes a round of ammunition comprising the cartridge of the invention and a missile having a rear end portion embraced in the missile receiving portion of the sleeve.

The missile is preferably pressed into the sleeve so that an abutment surface on the missile abuts the front end of the sleeve or the front end of a front portion of the body.

The sleeve is preferably made from a wear-resistant, hard, non-brittle material having sufficient resilience to absorb minor impacts without suffering permanent deformation, e.g. a material such as spring steel (preferably of a stainless type), phosphor-bronze or a reinforced plastics materials; and the body is preferably made from an easily worked rustless metal alloy such as stainless steel or brass, or a metal or alloy which can be diecast such as aluminum or an alloy thereof.

The sleeve is preferably cylindrical or tubular and has a wall thickness of less than 1mm, preferably about ½ mm, so as to be able to expand slightly as a missile of a relatively soft material, e.g. lead or plastics, is pressed into the sleeve, so as thereafter to grip the missile; and to facilitate insertion into the sleeve, the rear end of the missile may have a slight taper or chamfer. Furthermore, the sleeve, or the missile receiving portion, may be slotted at least partially along its length to facilitate expansion during insertion of the missile.

This invention is particularly, but not exclusively, applicable to cartridges of the kind described, such as the embodiments of cartridge disclosed herein which generally comprise a movable valve member having a plug at the front end to block a discharge passage in the front portion of the casing to retain compressed gas in the casing, which valve member can be moved forwards to move the plug forwards to unblock the discharge passage and release the compressed gas.

Such a cartridge is preferably arranged, in accordance with a further aspect of the present invention, so that forwards movement of the valve member brings a front end of the valve member into contact with the missile before the plug is moved far enough to unblock the discharge passage, whereby to advance the missile mechanically prior to the propellant gas being released to drive the missile.

In such a cartridge the sleeve performs the further valuable function of protecting the relatively delicate and accurately formed wall of the discharge passage.

The invention also includes a method of charging the cartridge and charging apparatus having means for:

(a) locating the cartridge in a charging chamber, (b) abutting the movbale valve member or a missile to which the movable member is appended to hold the valve member substantially in or closely adjacent to the normal position, and (c) pressurizing the charging chamber, whereby to displace the resilient sealing member or members, e.g. sealing ring or rings, to allow the cartridge to be pressurized without moving the movable valve member out of the passages.

The guns may be of any form, e.g. small arms, machine guns, cannon, nail guns, rivet guns and like guns for propelling a missile, such as a bullet, shell, nail, rivet, bolt or other forcibly driven article. In such guns, the cartridges of the invention offer the very considerable advantage of being useful in environments wherein the use of chemical explosive propellants would be hazardous, impractical or inconvenient.

BRIEF DESCRIPTION OF DRAWINGS

Forms of the invention will be described further, by way of example, with reference to the accompanying diagrammatic drawings, wherein:

FIG. 5 shows a detail of the second embodiment in which the cartridge is in a transient condition reached after firing prior to the discharging condition being achieved;

FIG. 6 is a rear end view of a movable member of the cartridge shown in FIGS. 3 to 5;

FIG. 7 shows a modified form of a base end portion of the cartridge;

DETAILED DESCRIPTION

Figure 1:
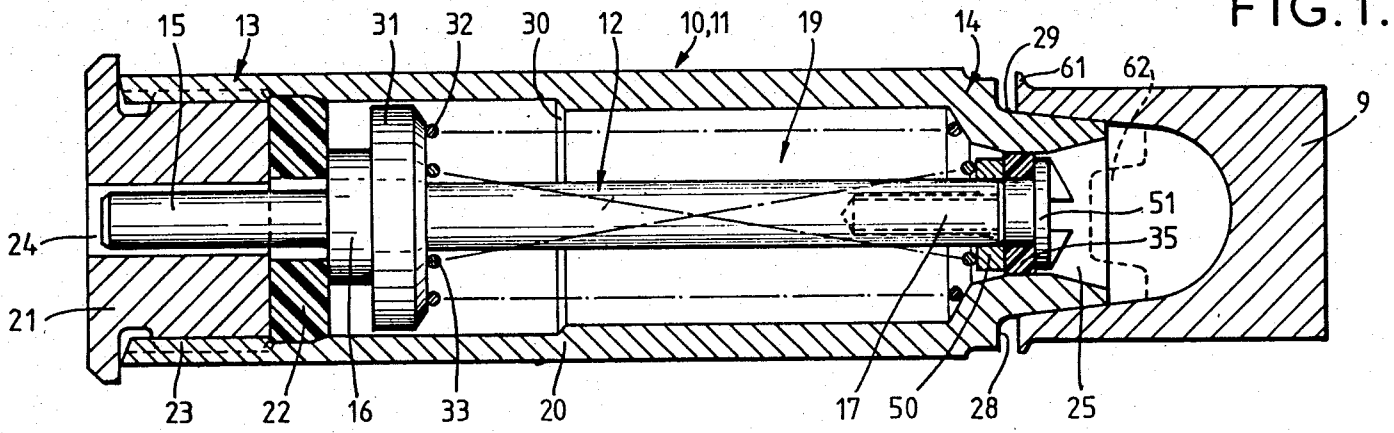
FIGS. 1 and 2 are longitudinal cross-section views of a first embodiment of the invention, showing the cartridge in a normal condition and a discharging condition respectively.

In all embodiments the round of ammunition generally comprises a missile 9, and a cartridge 10. The latter generally comprises a casing 11 and a movable valve member 12, the casing 11 having a rear base end portion 13 and a front discharge end portion 14, and the movable valve member having a closure member 16 and a front end part 17 provided with a plug 18. A gas storage space 19 is provided in the casing 11. The casing 11 comprises two components, namely a body 20 and a base insert 21. The insert 21 provides an axial actuating passage 24 for the base end portion 13. The passage 24 extends forward to a valve opening 52 leading to the space 19. The discharge end portion 14 provides an axial discharge passage 25 incorporating an intermediate cylindrical throat 26.

Referring to FIGS. 1 to 7, in the first and second embodiments the insert 21 is screwed into the body 20 to press an annular P.T.F.E. seal 22 into a peripheral seating to seal the threads 23. The seal provides the valve opening 52 at the front of the passage 24. The portion 14 provides an external conically tapered surface 27 which extends forwards from a forwardly directed abutment face 28.

Figure 2:
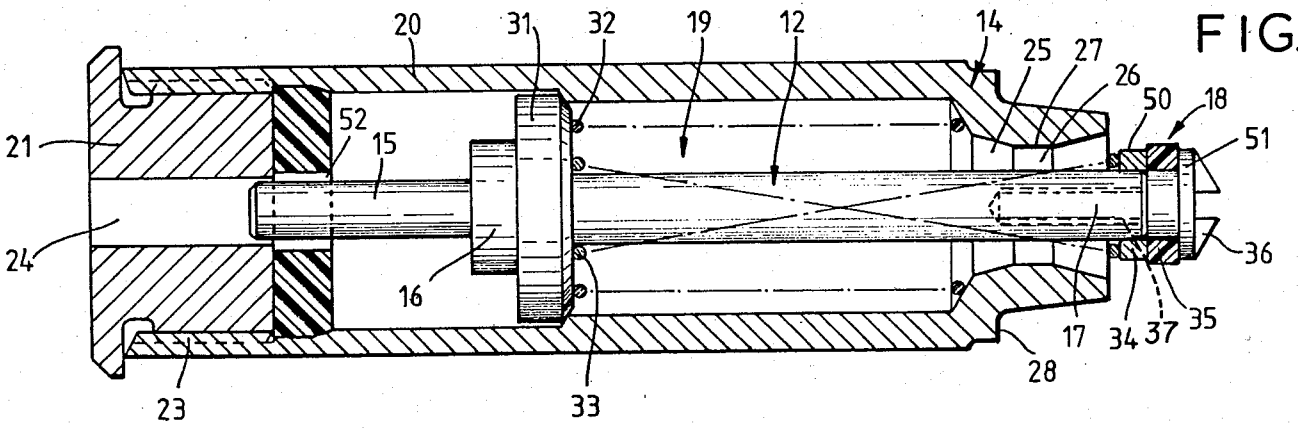

The movable member 12 is movable, by a base end part 15 (which part serves as an actuating member) being struck by a firing pin of a gun, forwardly from a normal position (FIGS. 1 and 3) to a discharging position (FIG. 2).

In the first embodiment shown in FIGS. 1 and 2 the body 20 is internally stepped to provide a rearwardly directed stop shoulder 30 engageable by a stop flange 31 on the movable valve member 12 to limit forwards movement of the movable member 12 to gas discharging position, e.g. as shown in FIG. 2. A bias spring 32 is located in the space 19 to engage and thrust apart the flange 31 and the discharge end portion 14, so as to bias the movable member 12 rearwards to the normal position in which the closure member 16 abuts a surface around the valve opening 52 and compresses the seal 22 so as to seal off the space 19 from the passage 24, and in which the plug 18 occupies and blocks the throat so that said space 19 serves as a chamber for storing gas under pressure.

The plug 18 also serves, in this embodiment, as an automatic non-return valve for use in charging the chamber with a gas, e.g. compressed air, and for this purpose comprises a valve spring 33 which reacts against the flange 31 to urge a washer 34 (FIG. 2) forwards to compress an elastomeric ring 35 against a head 36 of a screw threaded end piece 37 of the movable valve member, so that when gas under pressure is supplied externally to the front of the passage 25, the ring 35 and washer 34 can move rearwards, against the thrust of the spring 33, to admit gas into the space 19 through a small gap between the head 36 and the throat 26.

Figure 3:
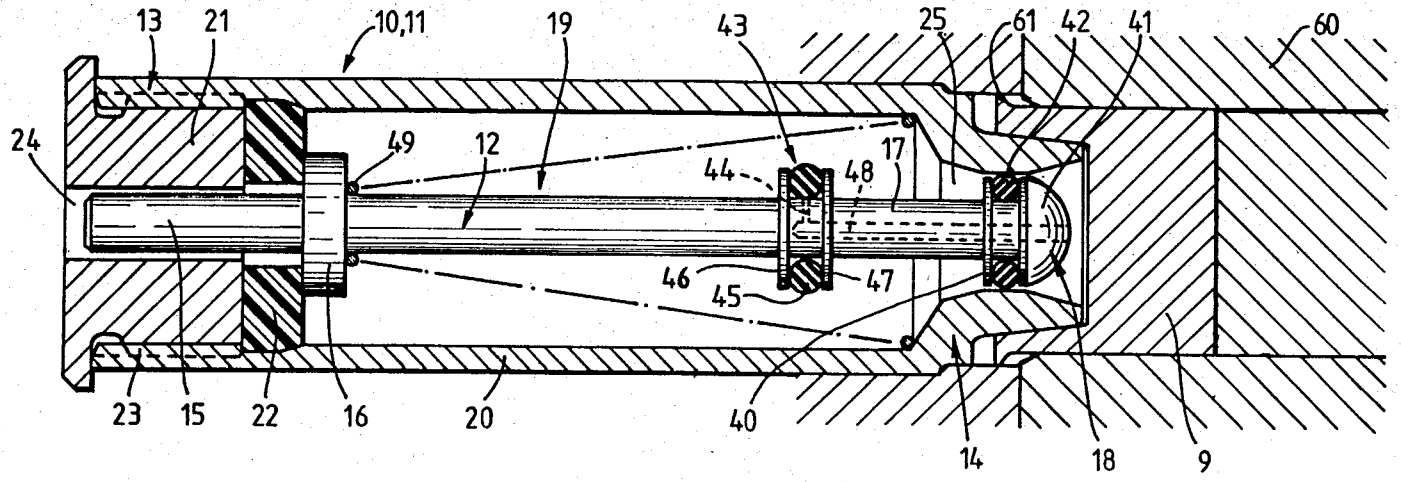
FIGS. 3 and 4 are views, similar to FIGS. 1 and 2, of a second embodiment of the invention.
Figure 4:
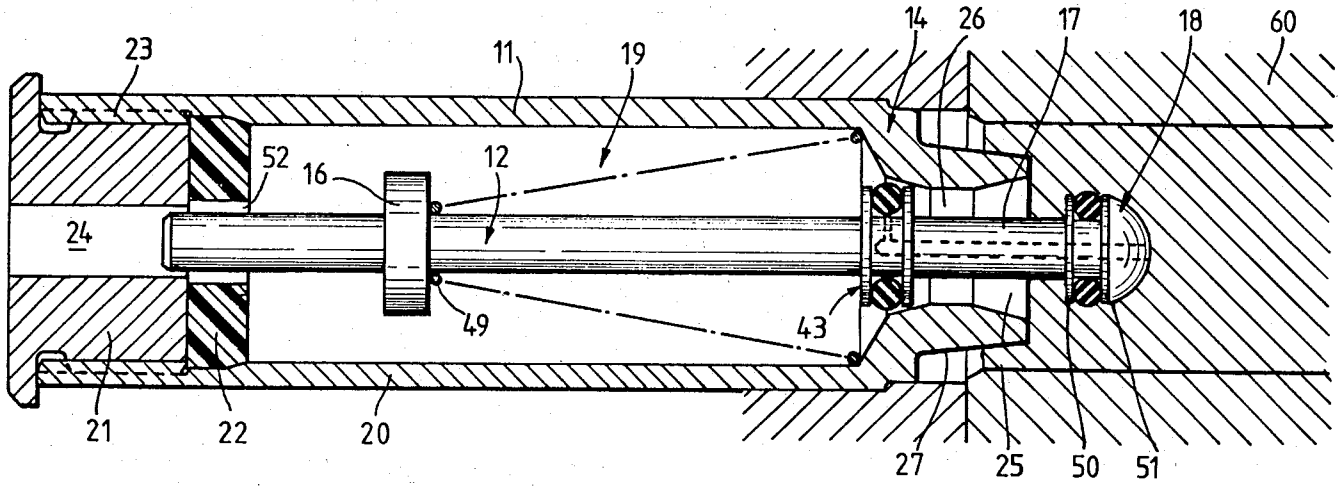
Figure 8:
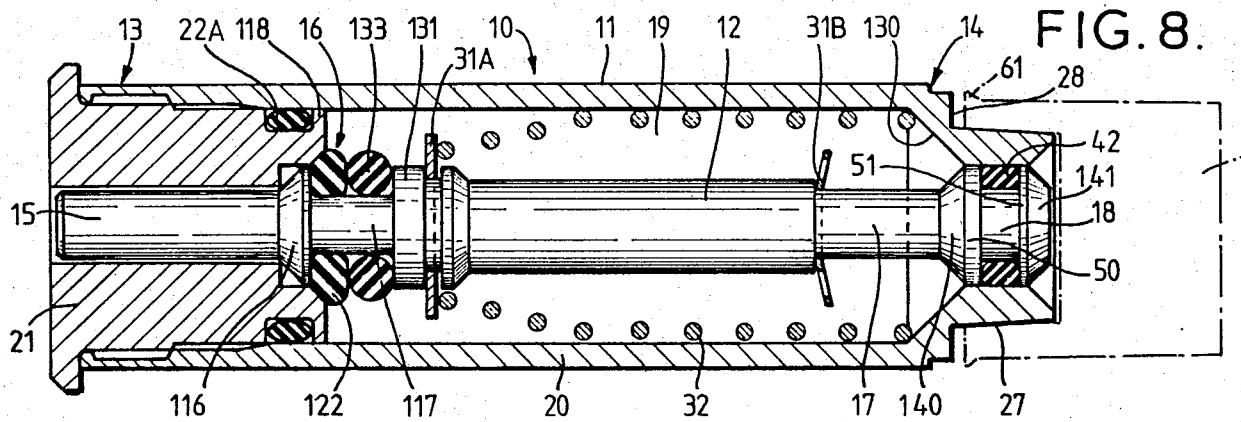
FIGS. 8, 9 and 10 are longitudinal cross-section views of a third embodiment of the invention, showing the cartridge in a normal condition, a dicharging condition and a recharging condition respectively.

In the second embodiment shown in FIGS. 3, 4 and 5 the body 20 around the space 19 is of simpler form. The plug 18 comprises a rear flange 40 and a head 14, integral with the movable member 12, together with an elastomeric "O"-ring 42 located between said flanges 40 and head 41.

The movable valve member 12 is provided with an automatic non-return valve 43 comprising a radial bore 44 covered by a second "O"-ring 45 located by further flanges 46 and 47, the bore 44 leading to an axial duct 48 which passes through the plug 18 to open at the front of the movable member 12. The movable valve member 12 is urged rearwards by a bias spring 49 which acts on the closure member 16.

In the first and second embodiments, the plug 18 provides a rear cylindrical surface 50 (on the washer 34 and on the rear flange 40), and a front cylindrical surface 51 (on the head 36 and on the head 41), which surfaces 50 and 51 are a close sliding fit in the throat 26. The axial lengths of the surfaces and the throat are such that, in the normal position, the front surface 51 is in the front end of the throat and the ring 35 or 42 overlies and seals the very small gap between the throat and the front surface 51; and in an transient intermediate position of the movable member the rear surface 50 is in the front end of the throat substantially to prevent the discharge of gas through the throat, as indicated in FIG. 5.

The radial dimensions of the base end part 15, closure member 16, the front end part 17 to the rear of the plug, and the plug 18 are determined so that the effective areas exposed to gas pressure derived thrusts acting longitudinally of the movable valve member are unequal in substantially all positions of the movable valve member. As indicated in FIG. 6 (which is not drawn to scale), the diameter, and thus the effective area, of the closure member 16 is greater than that of the plug 18, so that in the normal position a rearwardly directed force on the movable valve member arises from the gas pressure in the chamber; and the diameter of the base end part 15 is less than that of the plug 18 so that, when the closure member is moved forwards to open the valve opening 52 and expose the passage 24 to gas pressure, the movable valve member is subjected to a forwardly directed force arising from the gas pressure. Similarly, a forwardly directed force may arise if the front end part 17 is larger in diameter than the base end part 15 due to a forwards movement of the movable valve member serving to effectively increase the volume which can be occupied by the gas.

The diameter of the actuating passage 24 is slightly larger than that of the part 15, the latter a clearance sliding fit in the passage, so that any gas escaping through the passage exerts a rearwardly directed drag force on the part 15 to dampen or brake the forward movement of the movable valve member.

Said diameters and the springs 32 and 49 are preferably selected so that the momentum imparted to the movable valve member by the firing pin is initially supplemented by said forwardly directed thrust to cause the movable valve member to accelerate until a transient intermediate position is traversed; and so that, after said intermediate position has been traversed, said spring and rearwardly directed forces, together with the gas pressure drop to the rear of the plug and the rise in pressure (in the gun barrel) ahead of the plug thereafter decelerate, halt and reverse the movement of the movable valve member. The movable valve member is preferably halted prior to the flange 31 or 47 striking the body so that the extreme discharging position shown in FIGS. 2 and 4 is not reached unless, for example, the chamber has been overcharged with gas. In the second embodiment, the flange 47 serves also as a gas discharge limiting member in the event of overcharging.

In the second embodiment the geometrical relationship between the head 41 and the missile 9 is such that, in use, forward movement of the movable valve member 12 through the intermediate position causes the head 41 to abut and move the missile 9 forwards off the surface 27 and further into a barrel 60 of the gun so as to seat and seal a rifling flange 61 in the barrel in a relatively gentle manner, preferably prior to gas being released, as indicated in FIG. 5. Thus, as the plug moves further forwards, to clear of the throat, and gas discharges forcefully through the discharge passage to drive the missile 9, the missile accelerates rapidly without damage to or excessive gas leakage past the flange 61.

A similar geometrical relationship may be provided in the first embodiment, by extending the head 36 forwards or by extending an interior part 62 of the missile 9 rearwards as indicated in broken lines in FIG. 1. Many other useful variations of the first and second embodiments are possible within the scope of the invention. For example, while the casing and movable member are preferably wholly of metal, in order to withstand high gas pressures, e.g. of $7\times10^6$Pa (1000 pounds per square inch) and more, parts of the casing may be of plastics material, e.g. the integral base insert and seal member 63 shown in FIG. 7. In both embodiments, the internal diameter and hardness of the seal 22 or seal member 63 may be selected to constrict the actuation passage 24, especially when the seal is compressed by the movable valve member.

The size of the bore 44 and the hardness and thickness of the ring 45 may be selected to prevent overcharging of the chamber, e.g. to allow the ring to rupture and extrude through the bore when the pressure in the chamber reaches a predetermined value, so that the cartridge can be used in a weapon system which complies with the regulations pertaining to air guns in certain countries, e.g. as a cartridge for the gun described in said Specification No. 2116681A.

The bias springs may be omitted if the effective area of the closure member is greater than that of the plug, for holding the movable valve member in the normal position after the cartridge has been charged.

The bias spring may serve also as a stop to limit forward movement of the movable valve member.

In the first embodiment, the base end part 15 may be omitted, the cartridge being fired from a gun having an elongate firing pin to traverse the passage 24 to strike the member 16.

Some of these modifications are incorporated into the further embodiments disclosed herein.

In the third and fourth embodiments (FIGS. 8 to 13), the insert 21 is screwed into the body 20 and has an O-ring seal **22*a* to seal the threads 23, and the an external conically tapered surface 27 which extends forwards from a forwardly directed abutment face 28**.

As in the previous embodiments, the movable valve member 12 is movable, by the part 15 being struck by a firing pin of a gun, forwardly from a normal position (FIGS. 8, 12 and 13) to a discharging position (FIG. 9), against the bias of a closure spring 32.

The third and fourth embodiments differ from the first and second embodiments in that the closure member 16 generally comprises a rigid part 116, which is a close sliding fit in an enlarged front portion 124 of the passage 24, and an elastomeric sealing ring 122 on a seating 117 provided in front of the rigid part 116. In the normal position, the sealing ring 122 overlies and seals the slight clearance between the periphery of the part 116 and the surrounding surface of the insert 21 to close the valve opening 52.

The plug 18 comprises a rear flange 140 and a head 141, integral with the movable valve member 2, together with an elastomeric "O"-ring 42 located between said flange 140 and head 141.

Figure 9:
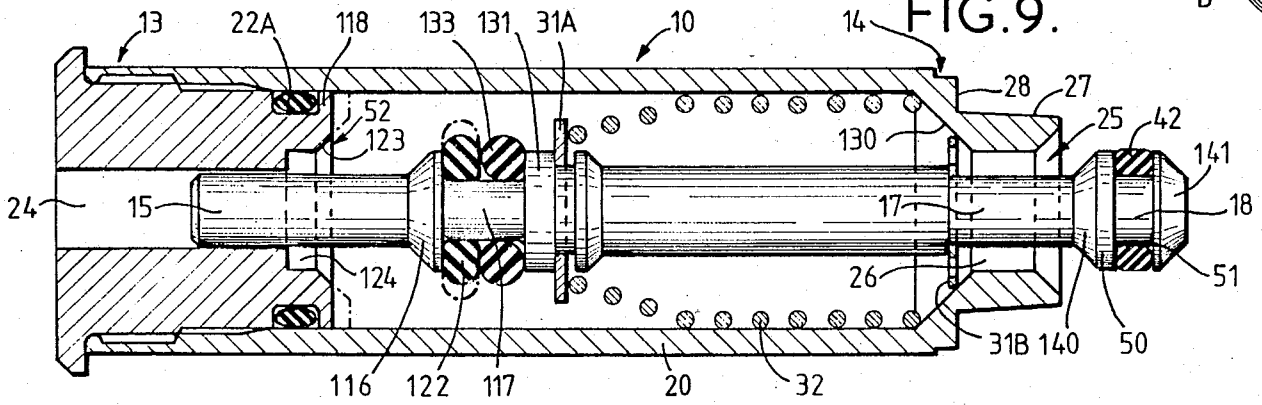

In the third embodiment shown in FIGS. 8 to 11 the discharge end portion 14 of the body 20 has a rearwardly directed stop face 130 engageable by a perforate spring clip stop 31B on the movable valve member 12 to limit forwards movement of the movable valve member 12 to gas discharging position, e.g. as shown in FIG. 9. The spring 32 is located in the space 19 to engage and thrust apart a circlip 31A on the movable valve member and the discharge end portion 14, so as to bias the movable valve member 12 rearwards to the normal position in which the closure member 16 closes valve opening 52 to the passage 24, and in which the plug 18 occupies and blocks the throat so that said space 19 serves as a chamber for storing gas under pressure.

In this embodiment, a resilient ring 133 reacts against a flange 131 on the member 12 to compress the elastomeric ring 133 rearwards against the rigid part 116.

The fourth embodiment (FIG. 12) is a simplified form of the third embodiment. The stop 31B, flange 131 and ring 133 are omitted, and the circlip 31A abuts the front of the ring 122, so that the ring 122 is urged rearwards. A land or flange 118 on the insert 21 is also omitted, so that the insert 21 in the fourth embodiment may be a simple diecasting.

The closure members 16 in the third and fourth embodiments are similar, in that a conically tapered abutment face 123 is provided in the front end of the insert 21 around the valve opening 52, which face 123 is sealingly engaged by the ring 122 in the normal position; and the rigid part 116 has substantially the same diameter as the flange 140.

Figure 13:
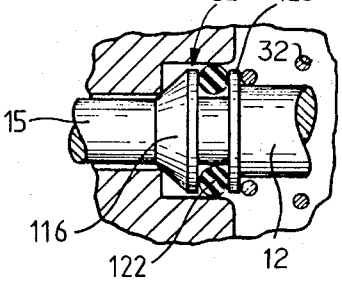
FIG. 13 shows a modified form of a base end portion of the cartridge.

In the fourth embodiment, the closure member 16 may be modified as shown in FIG. 13, so taht it is of similar construction to the plug 18, in that the ring 122 is located between the rigid part 116 and a front flange 125 of the closure member, and, in the normal position, is slidably located in the portion 124. The closure spring 32 acts on the front flange 125. The diameter of the part 116 is slighly greater than the diameter of the flange 140, in this embodiment.

In the third and fourth embodiments, the plugs 18 provide the rear cylindrical surface 50 on the rear flange 140, and the front cylindrical surface 51 on the head 141, which surfaces 50 and 51 are a close sliding fit in the throat 26 and function as described hereinbefore with reference to FIG. 5.

Figure 11:
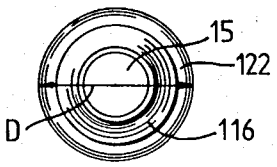
FIG. 11 is a rear end view of a movable member of the cartridge shown in FIGS. 8 to 10.

As in the first and second embodiments, radial dimensions of the base end part 15, closure member 16, valve opening 52, and the plug 18 are determined so that the effective areas exposed to gas pressure derived thrusts acting longitudinally of the movable valve member are unequal in substantially all positions of the movable valve member. The overall effective diameter, and thus the effective area, of the closure member 16 including the ring 122, e.g. as indicated in FIG. 11 by reference D, is slightly greater than that of the plug 18, so that in the normal position a rearwardly directed force on the movable member arises from the gas pressure in the chamber; and the diameter of the base end part 15 is less than that of the plug 18 so that, when the closure member is moved forwards to expose the passage 24 to gas pressure, the movable valve member is subjected to a forwardly directed force arising from the gas presure.

Said diameters and the spring 32 are preferably selected so that the momentum imparted to the movable member by the firing pin is initially supplemented by said forwardly directed thrust to cause the movable valve member to accelerate until the intermediate transient position is traversed, and so that said spring and rearwardly directed forces, together with the gas pressure drop to the rear of the plug and the rise in pressure (in the gun barrel) ahead of the plug thereafter decelerate, halt and reverse the movement of the movable valve member. The movable valve member is preferably halted, e.g. prior to the stop 31 striking the body.

Similarly, during initial forwards movement of the movable valve member from the normal position, the closure member reaches a transient position in which the rigid part 116 substantially blocks the passage 24 as the ring 122 is moved either off the face 123 or out of the portion 124 to open the valve opening, so as to prevent damage to the ring 122.

In use, forward movement of the movable valve member 12 through the intermediate transient position causes the head 141 to abut and move the missile 9 forwards to seat the missile in the barrel of the gun as previously described with reference to FIG. 5.

Figure 10:
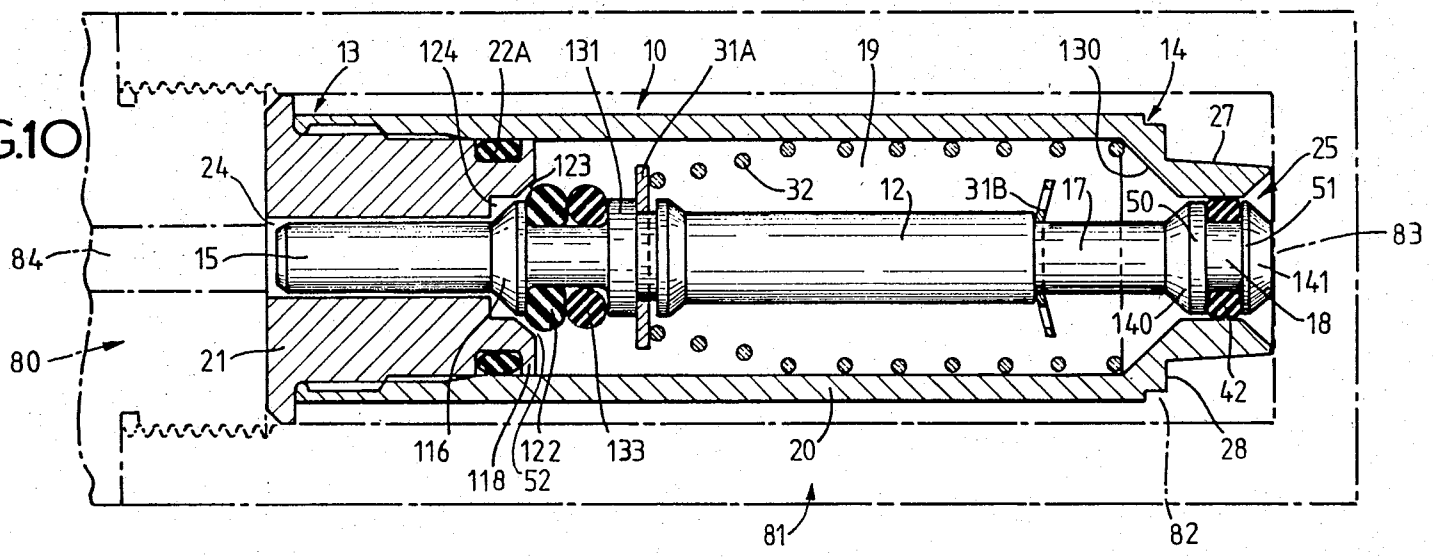

The closure member 16 and spring 32 are arranged to serve as non-return valve means for recharging of the cartridge in charging means comprising a mounting 80 and a housing 81, as indicated in broken lines in FIG. 10. The housing 81 is releasably connected to the mounting to define a charging chamber 82 in which the cartridge is situated so that the front end of the casing abuts a rigid stop 83 provided by a closed end of the housing 81. A charging duct 84 is provided in the mounting to enable the chamber to be pressurized. Upon pressurization, the movable valve member 16 is caused to move very slightly forwards until the head 141 abuts the stop 83. The movable valve member and portion 14, are dimensioned so that, when the position shown in FIG. 10 is reached, the rigid part 116 is separated slightly from the adjacent surface of the passage 24 and supports the ring 122 so that it is just clear or almost clear of the insert 21 and can, if necessary, be deflected easily by gas entering the chamber via the actuating passage 24. When the pressure in the chamber has risen to slightly below the charging pressure, the thrust of the ring 133 or the spring 32 (via the circlip 31A, FIG. 12) on the ring seal 122 causes the latter to re-engage the surface 123 to close the valve opening, and the spring 32 automatically returns the movable valve member to the normal position. As shown in FIG. 10, the stop 83 restricts forward movement of the plug so that the discharge passage 25 remains closed.

The third and fourth embodiments are not confined to the foregoing details examples and many variations are possible. For example, the casing and movable member are preferably wholly of metal, in order to withstand high gas pressures, e.g. about $1.4\times10^7$Pa of 2000 pounds per square inch) and more. To this end the ring 122 is preferably of a relatively hard elastomeri material, e.g. of about 90 shore hardness.

The closure spring may serve also as a stop to limit forward movement of the movable member.

The operational dynamics of these embodiments are particularly simple to vary by changing the size of the ring 122, and if necessary extending the abutment face 123, e.g. as indicated in broken lines in FIG. 9.

The third and fourth embodiments of cartridge have advantages over the first and second embodiments disclosed, in that blockage of the actuating passage by distortion of the P.T.F.E. or other seal 22 or 63 interposed between the closure member and the insert is obviated, thus reducing the risk of seal leakage causing premature discharge. This risk is further reduced by the ability of the cartridge to maintain the gas tight sealing in the event of the cartridge being dropped onto its front end, because the ring seal 122 can flex to absorb some slight forward movement of the part 116 without departing from the face 123 (FIG. 8, 10 and 12) or can move forwards without departing from the valve opening of passage 124 (FIG. 13).

In all four of the aforementioned embodiments, the effective areas of the closure member and the plug can be selected to give desired firing characteristics to suit particular guns and/or regulations pertaining to guns. For example, for use in a gun of the kind disclosed in said Specification No. 2116681 in which the firing pin has a predetermined momentum, the ratio of said effective areas may be such, that said momentum is only just sufficient to drive the closure member off the passage 124 when the cartridge is charged up to a predetermined maximum permissable pressure, e.g. $7\times10^6$Pa (11000 pounds per square inch) and is not sufficient to do so if the cartridge is significantly overcharged, whereby to prevent an overcharged cartridge being discharged. Conversely, for use in a firearm with a full bore and relatively heavy, e.g. zinc, missile, the cartridge may be designed to operate at a much higher pressure e.g. up to about $3\times10^7$Pa (4,000 pounds per square inch), and to permit actuation by a firing pin having limited momentum, the bias spring may be weak and said ratio may be small within the range of e.g. 1.001 to 1.2 to 1, for example 1.005:1.

The bias spring could be situated outside the gas storage chamber, e.g. in the base of the cartridge.

Referring to FIGS. 14 to 18, in the fifth embodiment, the inset 21 extends forwards within the casing 11 to provide a front portion 200 having four forwardly projecting fins 201 which abut the rearwardly directed abutment face 130 of the discharge end portion1 4. The front portion 200 provides a conically tapered abutment face 123 around the valve opening 52 at the front of an enlarged front portion 124 of the actuating passage 24, which portion 124 provides a seating for the closure member 16.

The form of valve member 12 shown in FIGURS 15 and 16 comprises an end-for-end symmetrical metal spool 202 having identical disc flanges 203 at each end, and a single elastomeric sealing ring 204 between the flanges 203. The flanges 203 are a close sliding fit in the throat 26 and a cylindrical part 205 of the front portion 124. The modified form of valve member 12 shown in FIG. 17 has a body 209 which is integral with a missile 9A, and is shown as having two elastomeric O-rings 208 whcih may be used instead of the ring 204 in either form of valve member 12.

The actuation passage 24 accommodates an optional base end part in the form of an elongate actuating member 15A which is retained in the cartridge by enlargements 206 at each end. However this actuating member 15A is omitted in the form of the cartridge shown in FIG. 18, and instead a base end opening 207 of the passage 24 is tapered for ease of entry of a firing pin 220 of a gun arranged to fire the cartridge.

Figure 18:
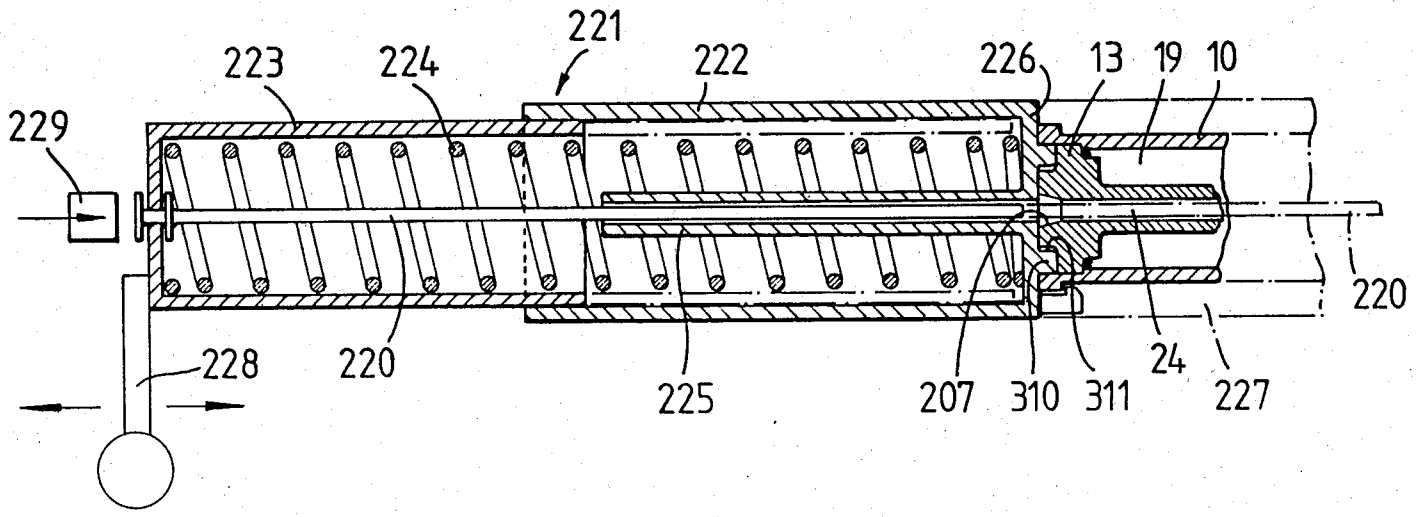
FIG. 18 is a diagram illustrating some features of a breech block of a gun for firing a modified form of the cartridge.

The gun has a telescopically expandable breech block 221 comprising a front part 22, rear part 223 and a spring 224 urging said parts to the expanded position as shown in FIG. 18. The firing pin 220 is mounted on the rear part 223 for limited movement relative thereto and extends forwards through a guide 225 provided by the front part 222.

The part 222 has a front 226 for abutting the cartridge and a rear end of a barrel 227 of the gun to close the breech; and can be drawn rearwards by rearwards movement of the rear part 223 to extract the cartridge and open the breech. A manually operable member 228 is connected to the rear part 223 to enable the breech block to be moved bodily rearwards from the position shown, and to enable the rear part 223 to be moved forwards relative to the front part to compress the spring and to extend the firing pin, from a retracted position in the guide, to an extended position in which it extends along the actuation passage to, or to close to, the valve member 12, as indicated in broken lines in FIG. 18, ready to be struck by a hammer or like firing pin driving member 229 of the gun.

The radial dimensions of the abutment face 123, and closure member 16, in relation to the radial dimensions of the throat 26 and the plug 18 are determined so that the effective closure areas exposed to gas pressure derived thrusts acting longitudinally of the movable valve member are unequal in substantially all positions of the movable valve member. The overall effective diameter, and thus the effective area, of the closure member 16 including the adjacent part of the ring 204 or 208 where it seals against the face 123 is greater than that of the plug 18 where it seals in the throat 26, so that in the normal position is net rearwardly directed force on the movable valve member arises from the gas pressure in the chamber. For example, in a cartridge of about 1 cm overall diameter the ratio of throat diameter to abutment face diameter is arranged so that when the cartridge is charged to a pressure of $2.8\times10^7$Pa a rearwards force of about 2N (2 kgm) is applied to the valve member 12. In a particular embodiment the end-for-end symmetrical valve member has a maximum dimension that is less than the missile diameter.

In use, when the valve member 12 is inserted, via the discharge passage 25, into the cartridge, the internal surfaces of the fins 201 serve as means to guide the closure member axially into the front portion 124, and the ring 204 or rings 208 resiliently engage the fins, the face 123 and the passage 25 to serve as retaining means to hold the valve member in the normal position.

For charging with gas, e.g. compressed air, at a high pressure, e.g. $2\times10^7$Pa (3000 lbs./sq. inch), the cartridge is inserted into the charging apparatus 80 whcih is modified to provide a raised abutment or stop 283 (indicated in FIG. 15) to prevent or substantially restrict movement of the valve member as the gas flows into the space 19 via the passage 24, around the flange 203, between the ring and the face 123, and, optionally also, the passage 25, past the other flange 203 and between the ring and the face 130, to pass between the fins 201. The flanges 203 are a clearance fit in the passages 24 and 25 to permit charging. Thereafter, a separate missile, e.g. the missile 9, is fitted to the cartridge to engage around or in the portion 14 or is held to the cartridge by a carrier, sleeve or nosepiece mounted on the portion 14, to form a round of ammunition ready for firing.

If the missile 9A is employed, the charging apparatus 80 will be adapted to provide a recess in the housing 81 to receive the head of the missile; and the recess will provide a rigid stop to abut the front of the missile to restrict forward movement of the valve member during charging.

Figure 16:
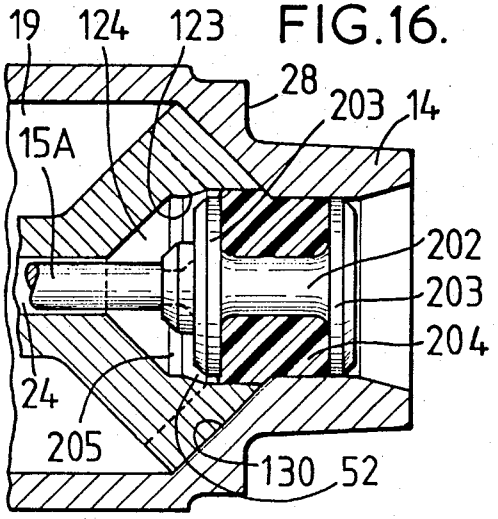
FIG. 16 is a view similar to FIG. 15, showing the cartridge at the instant of firing.
Figure 15:
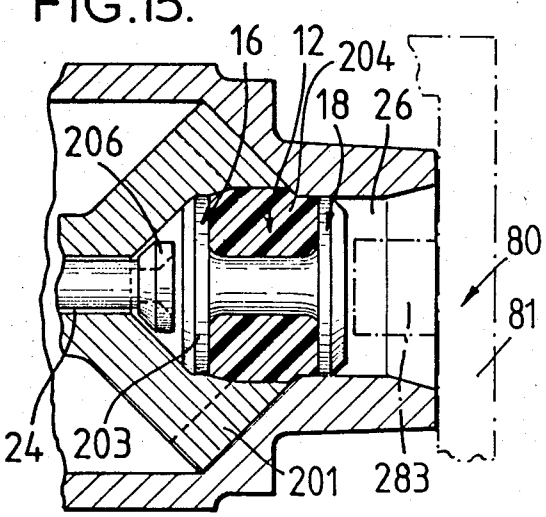
FIG. 15 shows a front (discharge end) portion of the fifth embodiment of cartridge with a movable valve member in a normal position ready for charging with compressed gas.
Figure 17:
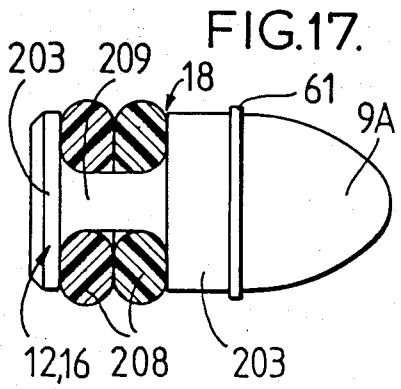
FIG. 17 shows a combined missile and movable valve member for the cartridge.

Upon firing, the valve member 12 is struck by the actuating member 15A or the firing pin 220 so as to be driven forwards by the impact to the transient valve opening position shown in FIG. 16 (and preferably to strike a rear central part 301 of the missile 9 to engage or advance the missile mechanically), whereby to open the sealed valve opening 52, to provide a gap between the ring and the face 123 to allow the gas to enter the front portion 124 of the passage 24. Pressurization of front portion 124 drives the valves member 12 rapidly through the discharge passage 25 and the gun barrel to expel both the valve member and the missile, and allows gas to escape via both passages 24 and 25. However, the amount of gas escaping along the actuation passage 24 is severely restricted by the actuating member 15A or the firing pin, so that most of the energy of the compressed gas is expended upon accelerating the missile.

The invention is not confined to details of the foregoing example, and many of the features of the cartridge and breech block disclosed in FIGS. 14 to 18 may be used in various combinations with features of the cartridges disclosed in FIGS. 1 to 13. For example, the rear part 15 may be omitted, and the breech block 221 used in the gun for firing such cartridges. Any of the cartridges and breech blocks may have safety means comprising a forwardly directed projection 310 on the front of the breech block and a projection reception recess 311 in the base of the cartridge (or vice versa) to allow the breech to be closed and to allow the firing pin to reach the actuating part or member 15 or 15A only when such a cartridge is in the breech but now when a standard explosive or other cartridge not having the recess 311 (or projection) is in the breech. E.g. a standard firearm breech block may be recessed to provide the reception recess, and the firing pin shortened, by a few millimeters, so that it cannot reach the primer cap or detonator of a standard explosive firearms cartridge. The invention further provides a breech block having such a projection or reception recess for use in a gun for firing cartridges of the invention. For further example, the rifling flange 61 on the missile 9 may also be provided on the missile 9A just ahead of the valve member 12.

Figure 12:
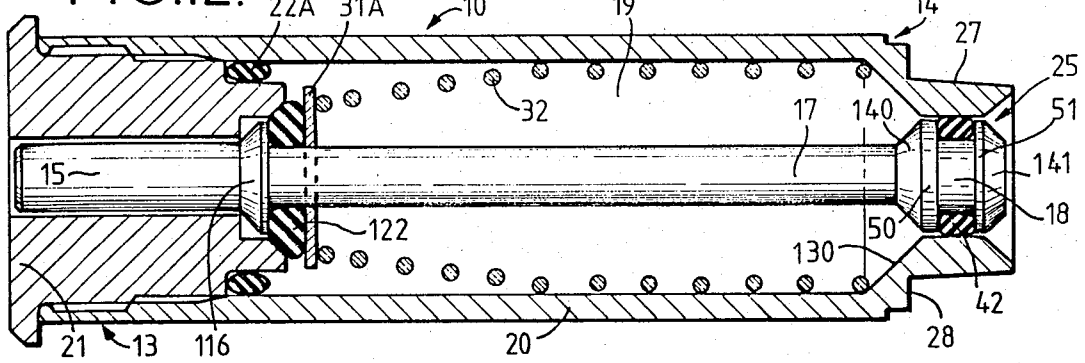
FIG. 12 is a view, similar to FIG. 8 of a fourth embodiment of the invention.
Figure 14:
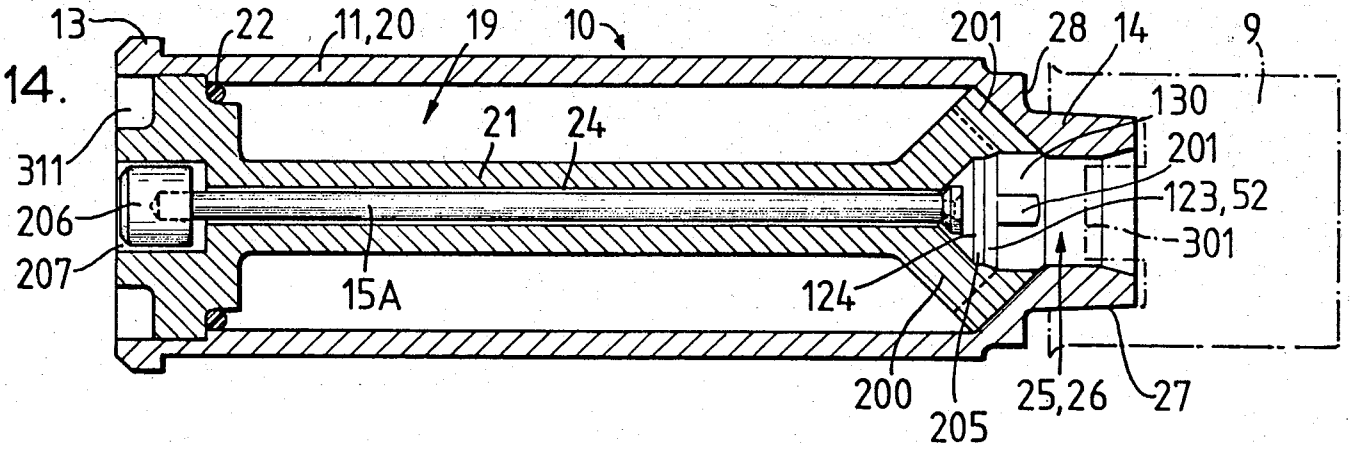
FIG. 14 is a longitudinal cross-sectional view of a discharged cartridge of a fifth embodiment of the invention.

The basic features of the fifth embodiment, (in that the valve member is dischargeble from the casing and may form a or part of a missile) are applicable to the previous embodiments, e.g. the fourth embodiment shown in FIG. 12, with some modification thereof to allow the valve member to pass through the discharge passage, e.g. by omitting the spring 32 and circlip 31A. However, it is preferred to make the overall length of the valve member less than the bore diameter of the barrel of the gun, except possibly for those instances wherein the valve member serves as, is secured to, or forms part of the missile.

Conversely, in the fifth embodiment, the member 15A may be part of, or fixed to, the valve member 12 so as to serve as the rear part or actuating member 15 or 15A, the opening 207 being lengthened to provide for sufficient forwards movement of the movable valve member.

The cartridges of the invention provide many advantages including, low cost, reliability, rapid gas discharge, easy recharding, good storage of gas at high pressures, e.g. pressure of $10^7$ to $4\times10^7$Pa and preferably between $1.4\times10^7$ and $3\times10^7$Pa, ease of actuation with minimal recoil related problems and particularly simple manufacture.

Figure 19:
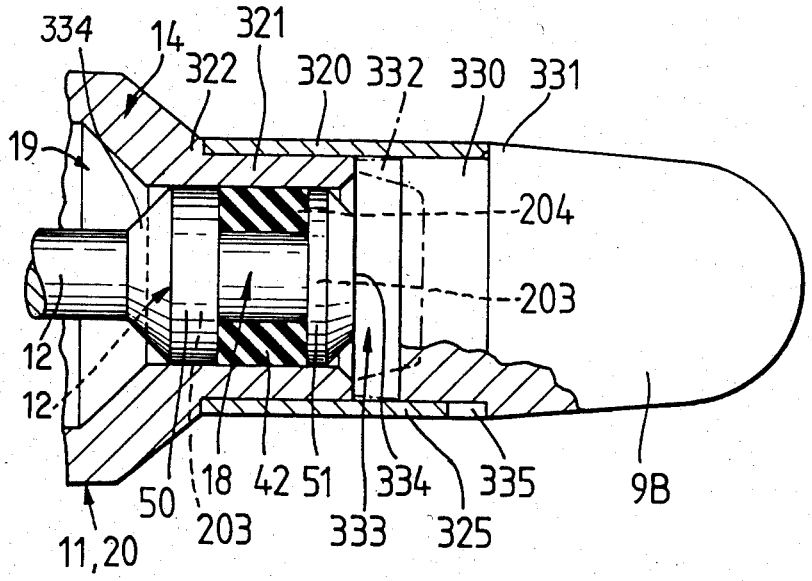
FIG. 19 shows a longitudinal cross-section through modified parts for the cartridges of the invention.

As shown in FIG. 19, a round of ammunition comprises a missile 9B and any of the aforementioned cartridges 11. The body 20 is preferably of a relatively free-machining stainless steel alloy, and is provided with a cylindrical or tubular sleeve 320 of stainless spring steel foil material about 0.4 mm thick.

The front portion 14 of the body has a thin-walled cylindrical extension 321 which extends forwards from a shoulder 322 provided by the portion 14.

The sleeve 320 is press or shrink fitted around said extension 321 so as to be supported thereby and to abut said shoulder 322; and has an axial length sufficient to extend forwards beyond said portion 14 to define a missile receiving space 323 (FIG. 20) within a missile receiving portion 325 of the sleeve.

Within the body 14 the valve member 12 may terminate at the line 324, for use in the fifth embodiment, or be of elongate form. The plug 18, which normally blocks the passage 25 to retain compressed air in the space 19, comprises the spaced apart flanges such as the flanges 50 and 51 or 203, which are a close sliding fit in the discharge passage, and an elastomeric sealing ring 42 or 204 between said flanges.

The missile 9B is of lead or a high lead content alloy, and is shaped to provide a rear portion 330 which is a push fit in the space 323 so as to be embraced by the sleeve 320. In the embodiment shown in FIG. 19, the rear portion 330 extends forwards to a shallow shoulder 331 on the missile, which shoulder 331 abuts the front end of the sleeve; but as an alternative to or in addition to the shoulder 331, the rear portion 330 may have a skirt 332 or rear end shaped to abut the front end of the extension 321 as indicated in broken lines, to limit insertion of the missile into the cartridge so as preferably to provide a small space 333 between the front end 334 of the valve member 12 and the rear portion 330.

To facilitate insertion of the missile, the front end of the sleeve 320 may be internally chamfered, and one or more short slots 335 may also be formed in the sleeve. The slot or one of the slots may extend further rearwards e.g. along the full length of the sleeve, and may be straight, helical or otherwise curved.

Figure 20:
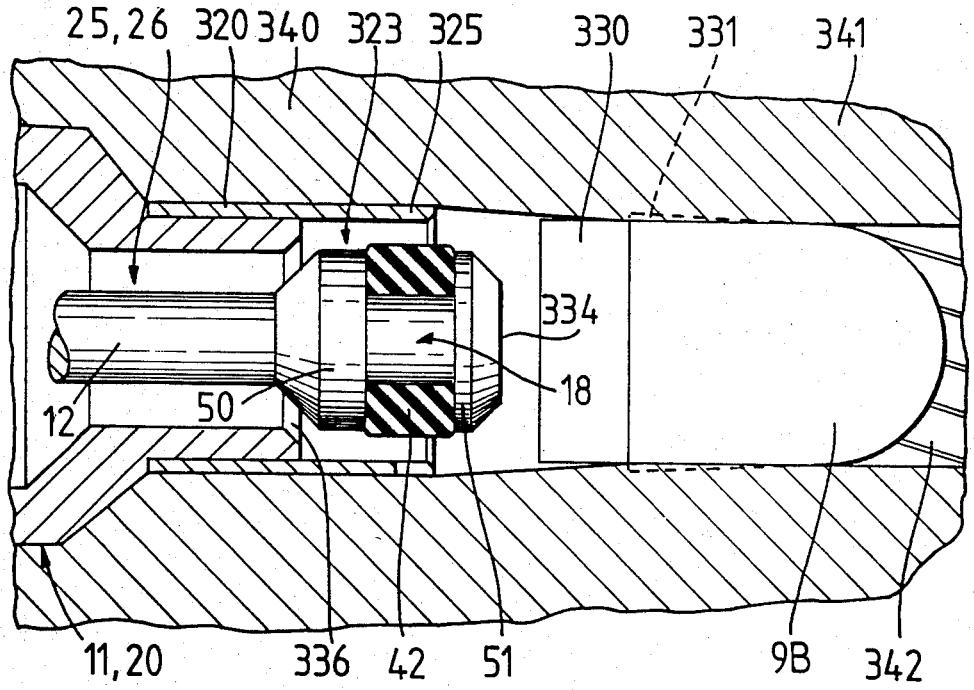
FIG. 20 is a view similar to FIG. 19 of the front parts, during firing in a gun, showing a missile at the instant of departure from the cartridge.

In use, as the round is loaded into the firing chamber in a gun, and the spent cartridge is ejected, the normal working shocks and impacts upon the front parts of the round are absorbed easily and without damage by the sleeve without the missile becoming displaced; and while the cartridges is in the firing chamber, the wall 340 of the latter supports the sleeve against being forced off the body by the firing of the round, as indicated in FIG. 20.

During firing the valve member 12 is very rapidly advanced, firstly to strike the missile and advance the missile into the barrel 341 to sealingly engage the rifling 342, and secondly to advance the plug 18 until ahead of the passage 25 to permit gas to discharge, via a gap 336, the space 323 and the firing chamber, into the barrel 341 to forcibly propel the missile.

Such a sleeve, of any suitable material, provides a low cost, easy to fit, easy to repair, durable, protective and reliable fixing for missiles, and can be selected, formed and dimensioned to suit missiles of most materials and shapes suitably used for missiles.

To further secure the sleeve, the latter may be welded, glued or otherwise bonded to the body, or may have a flange or formation which engages in, on, or behind a locating formation on or in the body, e.g. to the rear of the shoulder 322.

To accept missiles of relatively larger caliber on a cartridge of a standard construction, the body may include a cylindrical spacer on the front portion so as to be sandwiched between the extension 321 and a sleeve of appropriately larger diameter; or the wall diameter may be increased to accept such a sleeve.

Other variations of and modifications to the cartridge and round of ammunition may be made within the scope of the invention, particularly with respect to the shape and construction of the missile, which may be separately loadable into the gun and may be useful as a nail, rivet, dart, shell, punch or like forcibly driven article.

Further variations and modifications are applicable to some or all embodiments. In particular the or some of the resilient seals (such as the O-rings 35, 42, 122, 204 and 208) may be omitted from the movable valve member, and static flexible seals provided in the casing to sealingly engage surfaces (such as the surface 50 or extensions of the surfaces 50 and 131) provided on the plug and closure member, without departing from the fundamental principles of operation of the cartridges and the scope of the inventions. Such modifications may be designed to facilitate manufacture of the cartridges or to improve seal performance or operational, particularly for embodiments wherein the movable valve member is retained in the casing.

I claim:

1. A rechargeable ammunition cartridge comprising:
(a) a hollow pressure casing having a rear end and defining a gas storage space to hold compressed gas therein;
(b) a discharge passage in a front part of said casing and open to said gas storage space;
(c) an actuation passage extending into said casing and open at the rear of said casing;
(d) a valve opening disposed at a front end of said actuation passage and open to said gas storage space; and
(e) a valve member in said casing and having a normal position wherein it closes said valve opening at one end thereof and blocks said discharge passage with another portion thereof,
(f) said valve member is movable bodily forwardly from said normal position to open both said valve opening and said discharge passage to allow gas to escape from the pressure casing directly through both of said passages; and
(g) said valve member is dischargeable from the casing via the discharge passage.

2. A rechargeable ammunition cartridge comprising:
(a) a hollow pressure casing having a rear end and defining a gas storage space to hold compressed gas therein;
(b) a discharge passage in a front part of said casing and open to said gas storage space;
(c) an actuation passage extending into said casing and open at the rear of said casing;
(d) a valve opening disposed at a front end of said actuation passage and open to said gas storage space;
(e) a valve member in said casing and having a normal position wherein it closes said valve opening at one end thereof and blocks said discharge passage with another portion thereof;
(f) said valve member is movably bodily forwardly from said normal position to open both said valve opening and said discharge passage to allow gas to escape from the pressure casing directly through both of said passages; and
(g) said movable valve member having a rear portion of a predetermined area which engages a surface around the valve opening,
(h) said predetermined area being greater than the cross-sectional area of the portion of the discharge passage blocked by the valve member in the normal position, so that the gas pressure in the gas storage space exerts a resultant rearwardly directed force on the valve member; and
(i) a missile is disposed at the front of the casing, and
(j) said valve member is end-for-end symmetrical the maximum dimensions of said valve member is less than the missile diameter.

3. A rechargeable ammunition cartridge comprising:
(a) a hollow pressure casing having a rear end and defining a gas storage space to hold compressed gas therein,
(b) a discharge passage in a front part of said casing and open to said gas storage space;
(c) an actuation passage extending into said casing and open at the rear of said casing;
(d) a valve opening disposed at a front end of said actuation passage and open to said gas storage space; and
(e) a valve member in said casing and having a normal position wherein it closes said valve opening at one end thereof and blocks said discharge passage with another portion thereof,
(f) said valve member is movable bodily forwardly from said normal position to open both said valve opening and said discharge passage to allow gas to escape from the pressure casing directly through both of said passages;
(g) said movable valve member having a rear portion of a predetermined area which engages a surface around the valve opening,
(h) said predetermined area being greater than the cross-sectional area of the portion of the discharge passage blocked by the valve member in the normal position, so that the gas presure in the gas storage space exerts a resultant rearwardly directed force on the valve member;
(i) said valve member being disposed on a missile.

4. A rechargeable ammunition cartridge comprising in combination:
(a) a hollow pressure casing having a rear end and defining a gas storage space to hold compressed gas therein,
(b) a discharge passage in a front part of said casing and open to said gas storage space;
(c) an actuation passage extending into said casing and open at the rear of said casing;
(d) a valve opening disposed at a front end of said actuation passage and open to said gas storage space;
(e) a valve member in said casing and having a normal position wherein it closes said valve opening at one end thereof and blocks said discharge passage with another portion thereof;
(f) said valve member is movable bodily forwardly from said normal position to open both said valve opening and said discharge passage to allow gas to escape from the pressure casing directly through both of said passages;
(g) the movable valve member including resilient sealingmeans to seal said valve opening and said discharge passage in said normal position;
(h) charging means providing an abutment engageable by the movable valve member to hold said valve member substantially in said normal position during charging.

5. The combination of a gun and a cartridge for propelling a missile, the combination comprising:
(a) a hollow pressure casing having a rear end and defining a gas storage space to hold compressed gas therein;
(b) a discharge passage in a front part of said casing and open to said gas storage space;
(c) an actuation passage extending into said casing and open at the rear of said casing;

(d) a valve opening disposed at a front end of said actuation passage and open to said gas storage space;

(e) a valve member in said casing and having a normal position wherein it closes said valve opening at one end thereof and blocks said discharge passage with another portion thereof, (f) said valve member is movable bodily forwardly from said normal position to open both said valve opening and said discharge passage to allow gas to escape from the pressure casing directly through both of said passages; and (g) a gun including a breech block provided with a firing pin and with safety means to interengage safety means provided at the base of the cartridge to allow the breech block to be advanced to a position in which the firing pin is opertive to discharge the cartridge.

6. A cartridge as claimed in claim 5 wherein the gun has an elongate firing pin mounted on the breech block, and the breech block includes a front portion to close the gun breech, a rear portion on which the firing pin is mounted and bias means thrusting the rear portion rearwards relative to the front portion to urge the breech block to an extended condition in which the firing pin is retracted into the front portion.

7. A cartridge as claimed in claim 6 wherein the gun includes breech block control means for moving the breech block and moving the rear portion forwardly relative to the front portion to extend the firing pin to project in front of the front portion along said actuation passage.

8. A rechargeable ammunition cartridge comprising:

(a) a hollow elongate presure casing including a front portion and a rear portion;

(b) a gas storage space in said casing between said front portion and said rear portion;

(c) a rearwardly opening actuation passage extending forwardly through said rear portion;

(d) a valve opening at a front end of said actuation passage and open to said gas storage space;

(e) a forwardly opening discharge passage extending rearwardly through said front portion and open to said gas storage space;

(f) a sole valve member movably disposed in said casing;

(g) said valve member including elastomeric sealing means to effect sealing between said valve member and said discharge passage in a normal position of said valve member;

(h) said discharge passage including a cylindrical throat engaged by said sealing means in said normal position and is forwardly open to permit said sealing means to slide forwardly through the throat;

(i) said valve member is of non-servo form and includes firstly, a closure member portion, which in said normal position closes and abuts said valve opening to prevent rearward movement of the valve member, secondly a plug, which in said normal position is accommodated in said throat and cooperates with said sealing means to seal said throat, and, thirdly, a part rigidly connecting said plug and closure member portion;

(j) said valve member being movable only integrally bodily forwardly from said normal position, to move the closure member forwardly from said valve opening, and, in unison therewith, to slide the plug forwardly through and beyond the throat, to open both said valve opening and said throat for direct escape of compressed gas therethrough for simultaneous discharge of gas forwardly direct through the discharge passage and rearwardly direct through the actuation passage in said casing.

9. A cartridge as claimed in claim 8 wherein the actuating passage is coaxial with the longitudinal axis of the casing.

10. A cartridge as claimed in claim 8 wherein the valve member includes an actuating member section slidably disposed in said actuating passage and exposed at a rearward end of the casing.

11. A cartridge as claimed in claim 8 wherein the valve opening is defined by resilient sealing means, said resilient sealing means being fixed in the casing and abutted by the closure member in said normal position to prevent rearward movement of the valve member.

12. A cartridge as claimed in claim 8 wherein the valve opening has a greater diameter than said cylindrical throat.

13. A cartridge as claimed in claim 8 wherein a rearward part of the valve member rigidly includes the actuating member, the valve member is captive in said casing, and a spring is disposed in the casing to engage the valve member and extend forwardly in said storage space to engage said front portion within the casing.

14. A cartridge as claimed in claim 8 wherein the valve member carries stop means to limit forward movement of valve member from said normal position by engagement with the casing within said sapce, and the valve member includes an integrally formed actuating member and extends susbstantially from front to rear of said casing, coaxial within the casing, in said normal position.

15. A cartridge as claimed in claim 8 wherein the closure member includes further elastomeric sealing means mounted on the valve member adjacent to and forwards of the closure member, said casing includes an internal surface around said valve opening, which surface is engaged by said further sealing means and extends to a diameter greater than the diameter of the throat, so that the gas in said space exerts a resultant net rearwardly directed force on said valve member to retain the latter in said normal position, and said casing is abutted rigidly by said valve member to prevent rearward movement of the valve member from said normal position.

16. A cartridge as claimed in claim 15 wherein said internal surface is forwardly divergent.

17. A cartridge as claimed in claim 15 wherein said internal surface is cylindrical.

* * * * *